US008152295B2

(12) United States Patent
Komuro et al.

(10) Patent No.: US 8,152,295 B2
(45) Date of Patent: Apr. 10, 2012

(54) RECORDING APPARATUS

(75) Inventors: Shintaro Komuro, Shiojiri (JP); Nobuhiko Shinozaki, Shiojiri (JP); Yu Shinagawa, Shiojiri (JP); Sanshiro Takeshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 410 days.

(21) Appl. No.: 12/471,921

(22) Filed: May 26, 2009

(65) Prior Publication Data

US 2009/0295897 A1 Dec. 3, 2009

(30) Foreign Application Priority Data

May 27, 2008 (JP) ..... 2008-138751

(51) Int. Cl.
*B41J 2/01* (2006.01)
*B65H 1/00* (2006.01)

(52) U.S. Cl. ..... 347/104; 347/164; 271/162; 271/163

(58) Field of Classification Search ..... 347/104, 347/164; 271/162, 163
See application file for complete search history.

(56) References Cited

U.S. PATENT DOCUMENTS 6,360,657 B1 * 3/2002 Tanabe et al. ..... 101/44
6,871,949 B2 * 3/2005 Nakano et al. ..... 347/104
7,101,096 B2 * 9/2006 Sasai et al. ..... 400/48
8,002,402 B2 * 8/2011 Miyauchi ..... 347/104

FOREIGN PATENT DOCUMENTS

JP 2005-059584 3/2005

* cited by examiner

*Primary Examiner* — Daniel Petkovsek
(74) *Attorney, Agent, or Firm* — Workman Nydegger

(57) ABSTRACT

A recording apparatus includes a holding tray, a transport driving roller that applies a transport force to the other surface of the holding tray, and an ejection driving roller located downstream of the recording unit such that the ejection driving roller is placed on the same side as the transport driving roller. The other surface of the holding tray has an irregular pattern including a protrusion or a flat portion and a recess, the protrusion coming into contact with the outer surface of the transport driving roller, the recess being located so as to face the ejection driving roller.

18 Claims, 11 Drawing Sheets

RECORDING APPARATUS

BACKGROUND

1. Technical Field

The present invention relates to a recording apparatus capable of performing a recording operation on each of a first recording medium that is flexible, e.g., plain paper and a second recording medium that is rigid, e.g., a CD-R using a holding tray, the recording apparatus conceptually including a multifunction device typically including a printer, a facsimile machine, and a copier.

2. Related Art

An ink jet printer will be described below as an example of the recording apparatus. Some ink jet printers are capable of selectively performing a recording operation on a non-self-supporting flexible recording medium, such as a sheet of paper or a film, or a self-supporting rigid recording medium typified by an optical disk, such as a CD-R or a DVD-R. To perform the recording operation on a rigid recording medium, e.g., a CD-R, a dedicated holding tray is used. The holding tray is separately provided as an accessory for the printer. Alternatively, the holding tray is incorporated in a printer body of the printer, as disclosed in JP-A-2005-59584. The holding tray has a recess in which a recording medium, such as a CD-R, is received.

Transport of the two kinds of recording media to a recording zone and ejection of the two kinds of recording media to the outside of the printer are performed by a single transport roller mechanism and a single ejection roller mechanism, respectively. The transport roller mechanism includes a transport driving roller and a transport driven roller which are paired. The ejection roller mechanism includes an ejection driving roller and an ejection driven roller which are paired. To handle a rigid recording medium to be subjected to recording using the dedicated holding tray, the transport driving roller and the ejection driving roller are installed at the same level so that the recording medium located in the recording zone is parallel to an ink discharge surface of a recording head.

On the other hand, during transport of a flexible recording medium, it is preferred that the recording medium be pressed against a platen to stabilize the gap between the recording medium and the ink discharge surface of the recording head, since the recording medium is prevented from coming into contact with the recording head to increase recording quality. In this case, it is effective when a level (hereinafter, "installation level") at which the ejection driving roller is installed is higher than that at which the transport driving roller is installed.

In the case where the installation level of the ejection driving roller is higher than that of the transport driving roller, when a rigid recording medium is transported using the holding tray, the holding tray and the recording medium are tilted. Disadvantageously, the parallelism of the recording medium relative to the ink discharge surface of the recording head is reduced. Accordingly, when a recording operation is performed on the rigid recording medium, the gap between the ink discharge surface of the recording head and the recording surface of the recording medium is unstable, leading to degraded recording quality.

SUMMARY

An advantage of some aspects of the invention is that while the installation level of the ejection driving roller is higher than that of the transport driving roller, a recording medium and the holding tray can be supported and transported with the parallelism kept high.

According to an aspect of the invention, a recording apparatus includes a holding tray, a recording unit capable of performing a recording operation on each of a first recording medium and a second recording medium set on one surface of the holding tray, a transport driving roller that applies a transport force, directed toward the recording unit, to the other surface of the holding tray on which the second recording medium is set, and an ejection driving roller located downstream of the recording unit such that the ejection driving roller is placed on the same side as the transport driving roller, the ejection driving roller applying an ejection force to the first recording medium, the ejection force acting in the direction in which the first recording medium is ejected. The other surface of the holding tray has an irregular pattern including a protrusion and a recess, the protrusion being come into contact with the outer surface of the transport driving roller, and the recess being located so as to face the ejection driving roller.

According to this aspect, the installation level of the ejection driving roller can be set higher than that of the transport driving roller such that the difference between the installation levels lies in the range corresponding to the difference in level between the protrusion and the recess of the irregular pattern in the other surface of the holding tray. When the first recording medium that is flexible is transported, therefore, the first recording medium is pressed against a platen included in the recording unit to further stabilize the gap between the platen and the ink discharge surface of a recording head. Advantageously, the first recording medium is prevented from coming into contact with the recording head, thus increasing recording quality.

On the other hand, when the second recording medium that is rigid is transported, the degree of tilt of the holding tray and the second recording medium is reduced within the range corresponding to the difference in level between the protrusion and the recess in the other surface of the holding tray to ensure the parallelism of the second recording medium relative to the ink discharge surface of the recording head. Similarly, the gap between the recording head and the recording surface of the second recording medium can be stabilized, thus increasing the recording quality.

Preferably, the depth of the recess is set so that when the holding tray is transported, the bottom surface of the recess comes into contact with the outer surface of the ejection driving roller.

In this case, while the second recording medium is passing through a recording zone, the holding tray is transported such that the top surface of the protrusion in the other surface of the holding tray is in contact with the outer surface of the transport driving roller and the bottom surface of the recess in the other surface thereof is in contact with the outer surface of the ejection driving roller. Advantageously, the parallelism of the holding tray and the second recording medium relative to the ink discharge surface of the recording head can be easily ensured.

Preferably, the depth of the recess is set so as to form a space between the bottom surface of the recess and the outer surface of the ejection driving roller, and while the holding tray is transported, the posture of the holding tray is held by the transport driving roller and another posture keeping member.

In this case, the holding tray is transported while not being in contact with the ejection driving roller. Therefore, when both the transport force of the transport driving roller and the ejection force of the ejection driving roller are applied to the holding tray, the holding tray is not affected by the difference between the applied forces. The holding tray and the second recording medium can be more smoothly transported with higher accuracy. In addition, during transport, the posture of the holding tray, namely, the parallelism can be ensured by the transport driving roller and another posture keeping member.

Preferably, the recess includes a plurality of grooves extending in the direction in which the recording medium is transported, the grooves each having such a width as to receive a plurality of the ejection driving rollers.

In this case, since the grooves are provided in the other surface of the holding tray, the same advantages as those described above can be obtained with the simplified structure of the holding tray.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording apparatus according to a preferred embodiment of the invention will be described below. The recording apparatus includes a recording-medium transport device. An ink jet printer 1 will now be described as the recording apparatus according to the preferred embodiment and the entire structure of the ink jet printer 1 will be described with reference to FIGS. 1 and 2.

Figure 1:
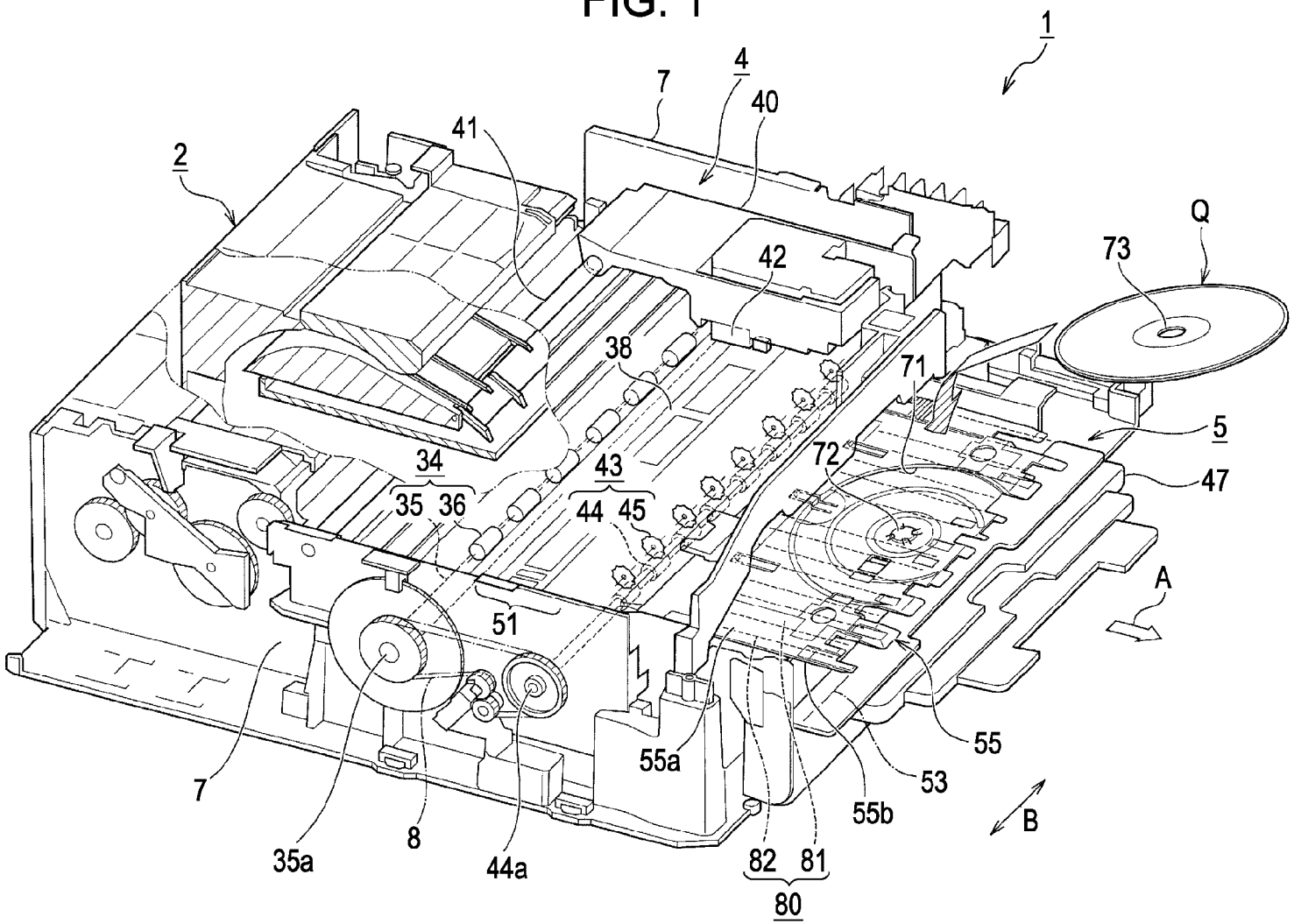
FIG. 1 is a perspective view of an ink jet printer when a holding tray is located in a set position, FIG. 1 illustrating the internal structure of the printer.
Figure 2:
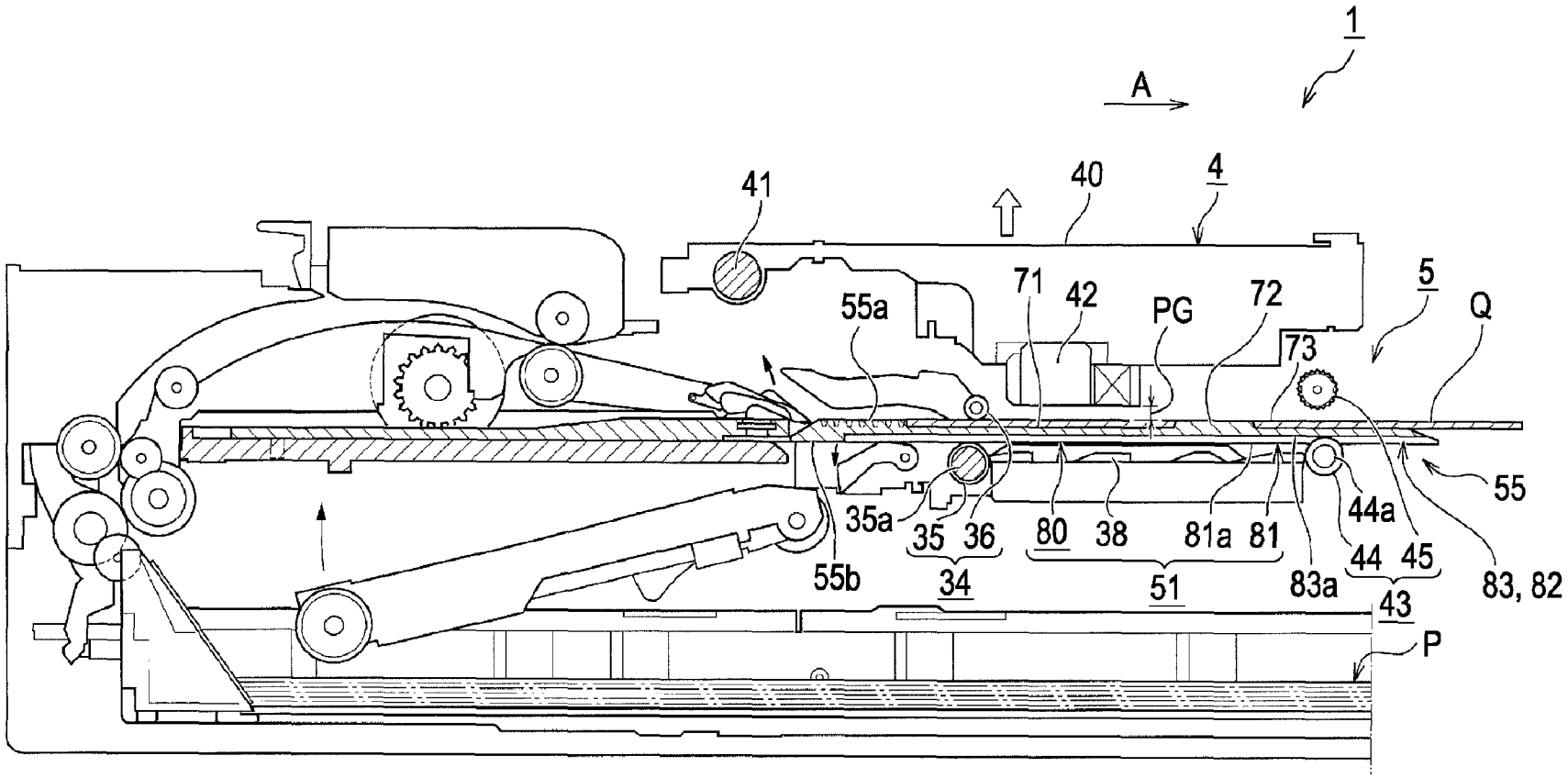
FIG. 2 is a sectional side elevation view of the ink jet printer when the holding tray is located in a recording zone, FIG. 2 schematically illustrating the internal structure of the printer.

FIG. 1 is a perspective view of the ink jet printer 1 and illustrates the internal structure thereof. In FIG. 1, a holding tray is located in a set position. FIG. 2 is a sectional side elevation view of the ink jet printer 1 and schematically illustrates the internal structure thereof. In FIG. 2, the holding tray is located in a recording zone. The ink jet printer 1 is a multifunction ink jet printer including an image scanner (not shown) mounted on the tope of the printer and is capable of performing a recording operation on each of a first recording medium P that is flexible, e.g., a sheet of paper or a film, and a second recording medium Q that is rigid, e.g., an optical disk such as a CD-R or a DVD-R.

The ink jet printer 1 includes a printer body 2, serving as a recording-apparatus body which is a rectangular chassis having relatively flat surfaces in appearance. The ink jet printer 1 further includes the recording-medium transport device (hereinafter, also referred to as "transport device"), indicated at 5, and a recording device 4. Those devices are arranged in the printer body 2. The transport device 5 transports the first recording medium P or the second recording medium Q to the recording zone, indicated at 51, and ejects the first recording medium P or the second recording medium Q, subjected to a desired recording operation, to the outside of the printer body 2. The recording device 4 performs a desired recording operation on the transported first or second recording medium in the recording zone 51.

The transport device 5 includes the holding tray, indicated at 55. The holding tray 55 has a set recess 71 in which the second recording medium Q is set and a chuck 72 holding the inner periphery 73 of the second recording medium Q. The set recess 71 and the chuck 72 are disposed on the upper surface, indicated at 55*a*, of the holding tray 55. The lower surface, indicated at 55*b*, of the holding tray 55 has an irregular pattern 80 which will be described later. In addition, the transport device 5 includes a transport roller mechanism 34 and an ejection roller mechanism 43. The transport roller mechanism 34 includes a transport driving roller 35 and a plurality of transport driven rollers 36 to transport any of the two kinds of recording media P and Q toward the recording zone 51. The ejection roller mechanism 43 includes a plurality of ejection driving rollers 44 and a plurality of ejection driven rollers 45 to eject the recording medium P or Q, subjected to recording, to the outside of the printer body 2 (to the front of the printer body 2 in this embodiment). The ejection driven rollers 45 are moved to a retracted position, where the ejection driven rollers 45 are not in contact with the second recording medium Q, by a release mechanism (not shown).

The holding tray 55 is a rectangular plate-shaped member whose depth is short in this embodiment. On the upper surface 55*a* of the holding tray 55, the set recess 71 is located in the middle of the width direction B along the width of the printer body 2 such that the chuck 72 in the set recess 71 is slightly close to the front edge of the holding tray 55. As for the second recording medium Q which can be set in the holding tray 55, any of various optical disks having a size intended to be used, for example, a diameter of 12 cm or 8 cm is available. For example, a CD-R, a CD-RW, a DVD-R, a DVD-RW, a Blu-ray disc which has received attention as a next-generation optical disk, and an optical disk which will be developed are available.

The transport roller mechanism 34 includes the transport driving roller 35, which is long and extends in the width direction B, and the transport driven rollers 36, which are short and are pressed into contact with the outer surface of the transport driving roller 35. The transport driven rollers 36 are arranged at appropriate intervals in the width direction B. The transport driving roller 35 is provided on a roller drive shaft 35*a* which horizontally extends between side frames 7 and 7 in the printer body 2.

The ejection roller mechanism 43 includes the ejection driving rollers 44, serving as a plurality of short rubber rollers disposed at appropriate intervals in the width direction B, and the ejection driven rollers 45, serving as a plurality of toothed disc-like rollers each of which is paired with the corresponding ejection driving roller 44. The ejection driving rollers 44 are provided on a roller drive shaft 44*a* which horizontally extends between the side frames 7 and 7 in the printer body 2. The rotation of the roller drive shaft 35*a* of the transport driving roller 35 is transferred through a timing belt 8 to the roller drive shaft 44*a* so that the ejection driving rollers 44 are rotatable synchronously with the transport driving roller 35. The first recording medium P ejected by the ejection roller mechanism 43 can be stacked on an ejection stacker 47 placed so as to extend forwardly from the printer body 2.

The recording device 4 fundamentally includes a carriage 40 placed above the recording zone 51, a recording head 42 mounted on the lower surface of the carriage 40, and a platen 38 placed below the recording zone 51.

The carriage 40 is reciprocative along a carriage guide shaft 41 extending in the width direction B perpendicular to the transport direction A in which the second recording medium Q is transported. The recording head 42 discharges ink supplied from an ink supplier (not shown) through a nozzle (not shown) located on an ink discharge surface, serving as the lower surface of the head, to perform a direct recording operation on a recording surface, serving as the upper surface of the first or second recording medium P or Q. The platen 38 is a member that guides the transported recording medium P or Q, namely, supports the lower surface of the transported first recording medium P in the recording zone 51 or the lower surface 55*b* of the above-described holding tray 55 on which the second recording medium Q is set, and defines a gap PG between the ink discharge surface, serving as the lower surface, of the recording head 42 and the recording surface, serving as the upper surface, of the first or second recording medium P or Q.

First Embodiment

The structure and operation of the recording-medium transport device 5 in the ink jet printer 1 according to a first embodiment will be concretely described below with reference to FIGS. 3 to 9.

Figure 3:
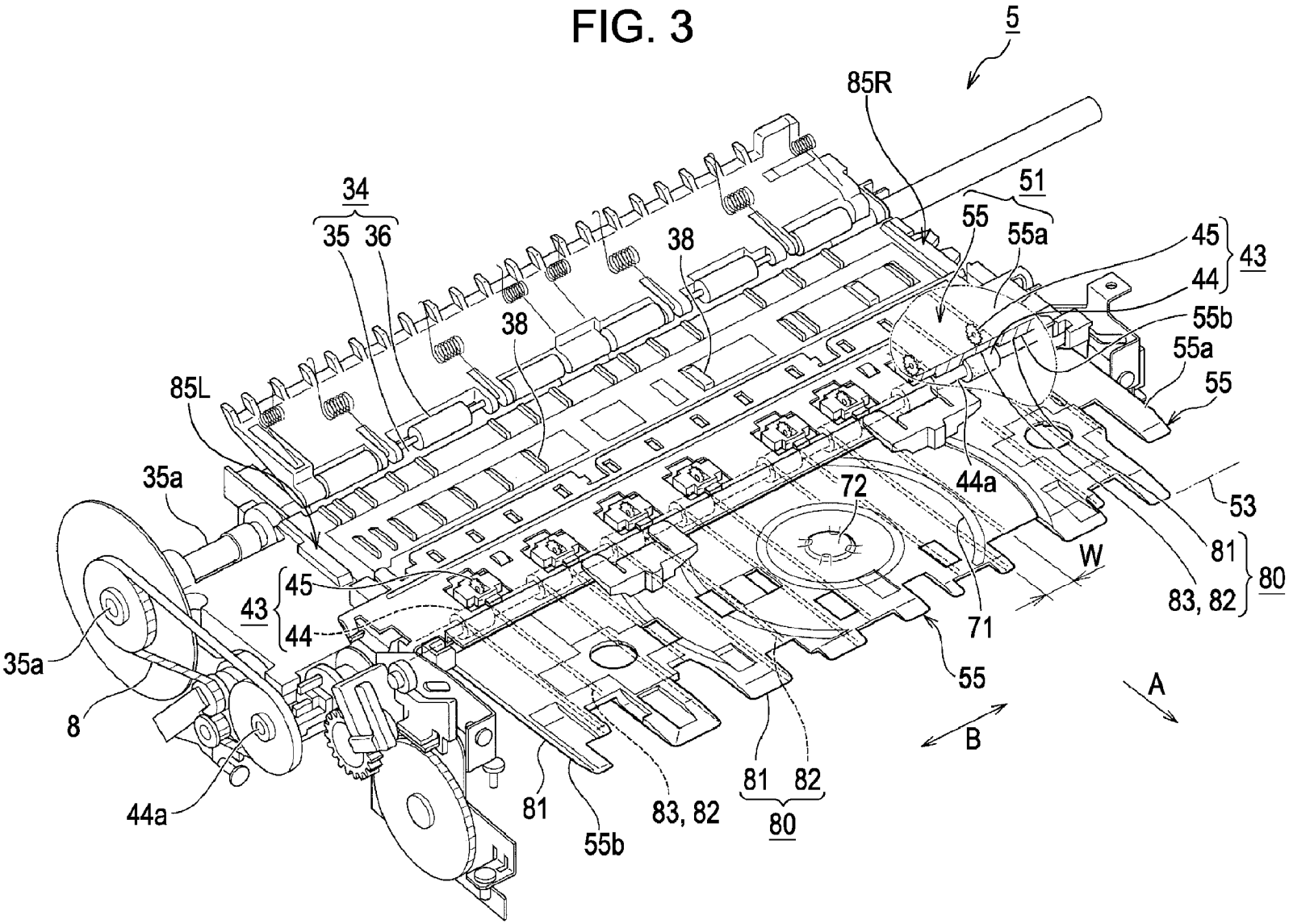
FIG. 3 is a perspective view of the ink jet printer when the holding tray, included in a recording-medium transport device, is located in the set position.
Figure 4:
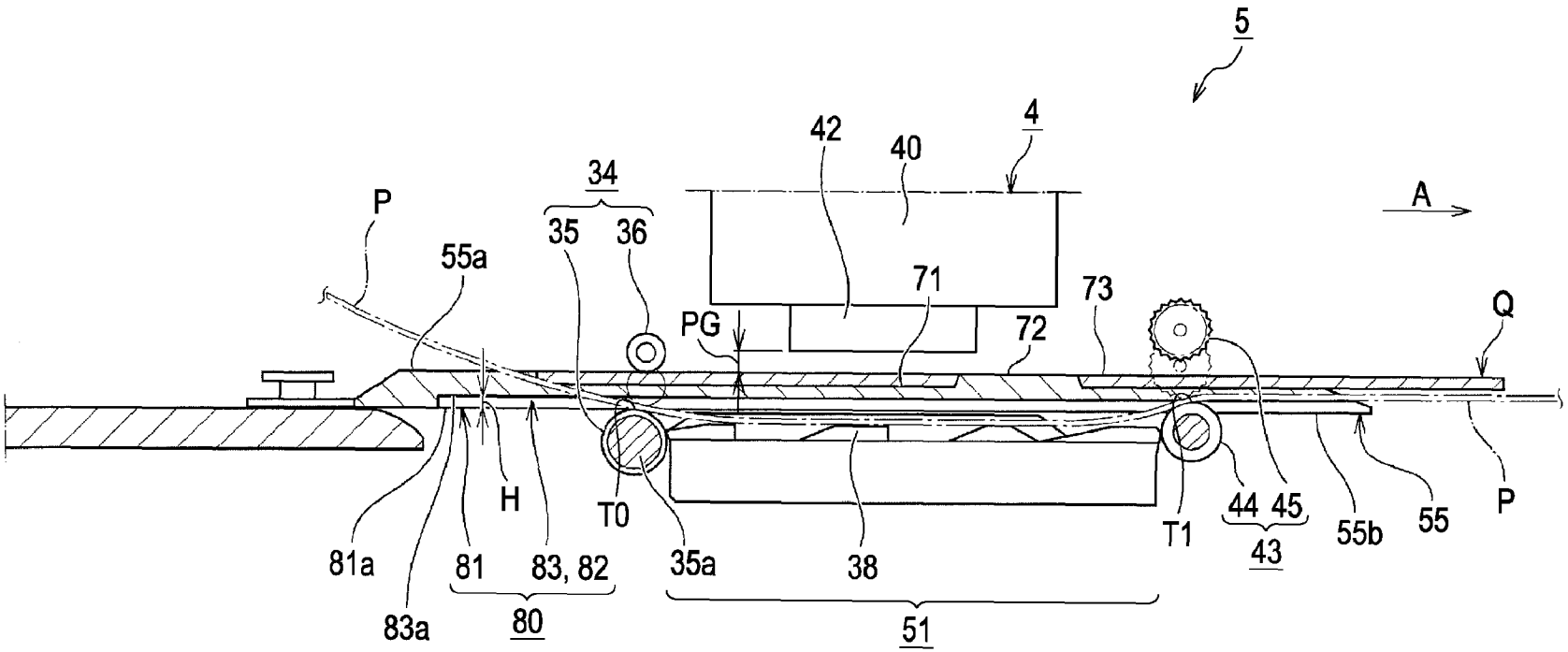
FIG. 4 is a sectional side elevation view of the ink jet printer when the holding tray is located in the recording zone.
Figure 5:
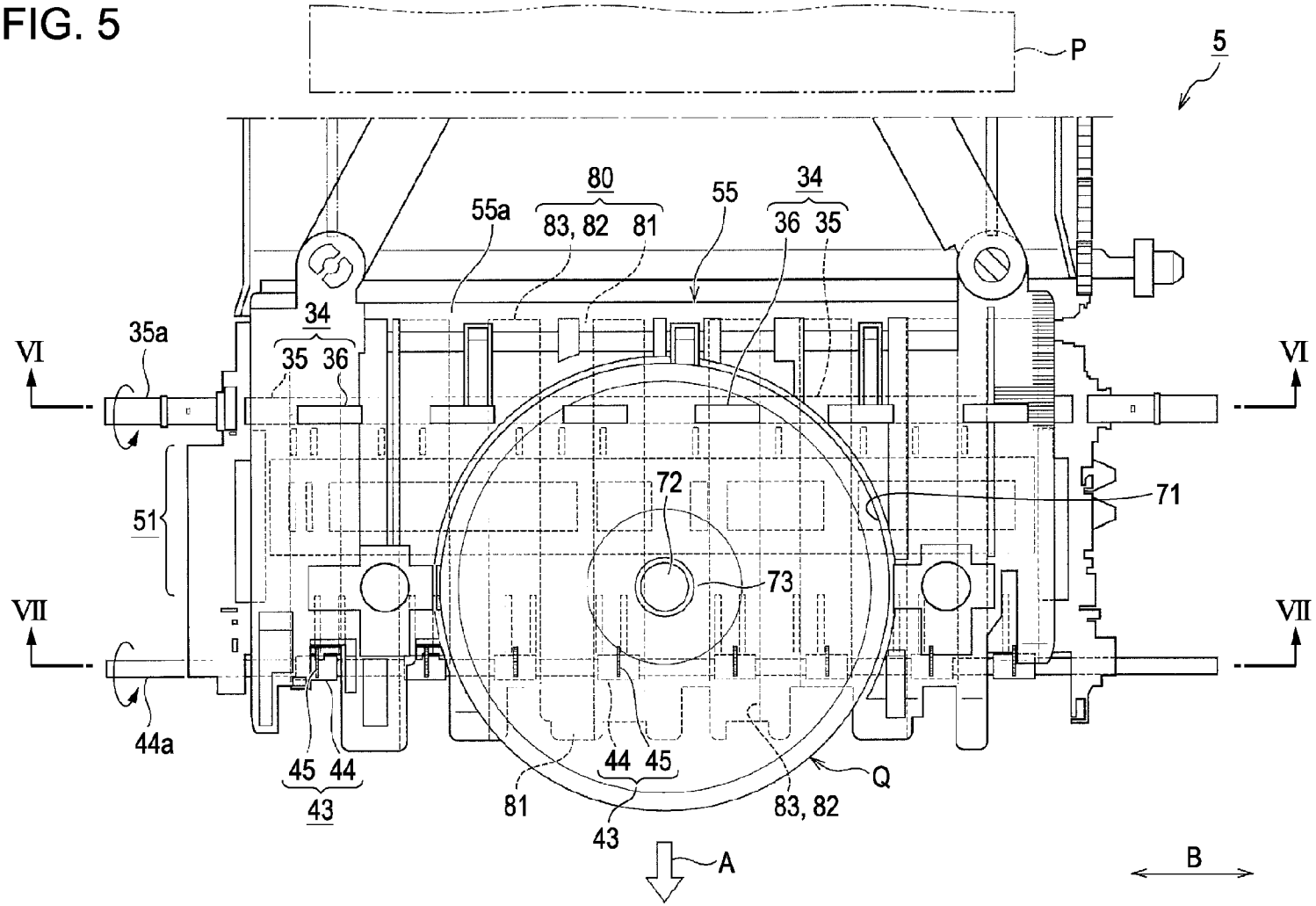
FIG. 5 is a plan view of the ink jet printer when the holding tray is located in the recording zone.
Figure 6:
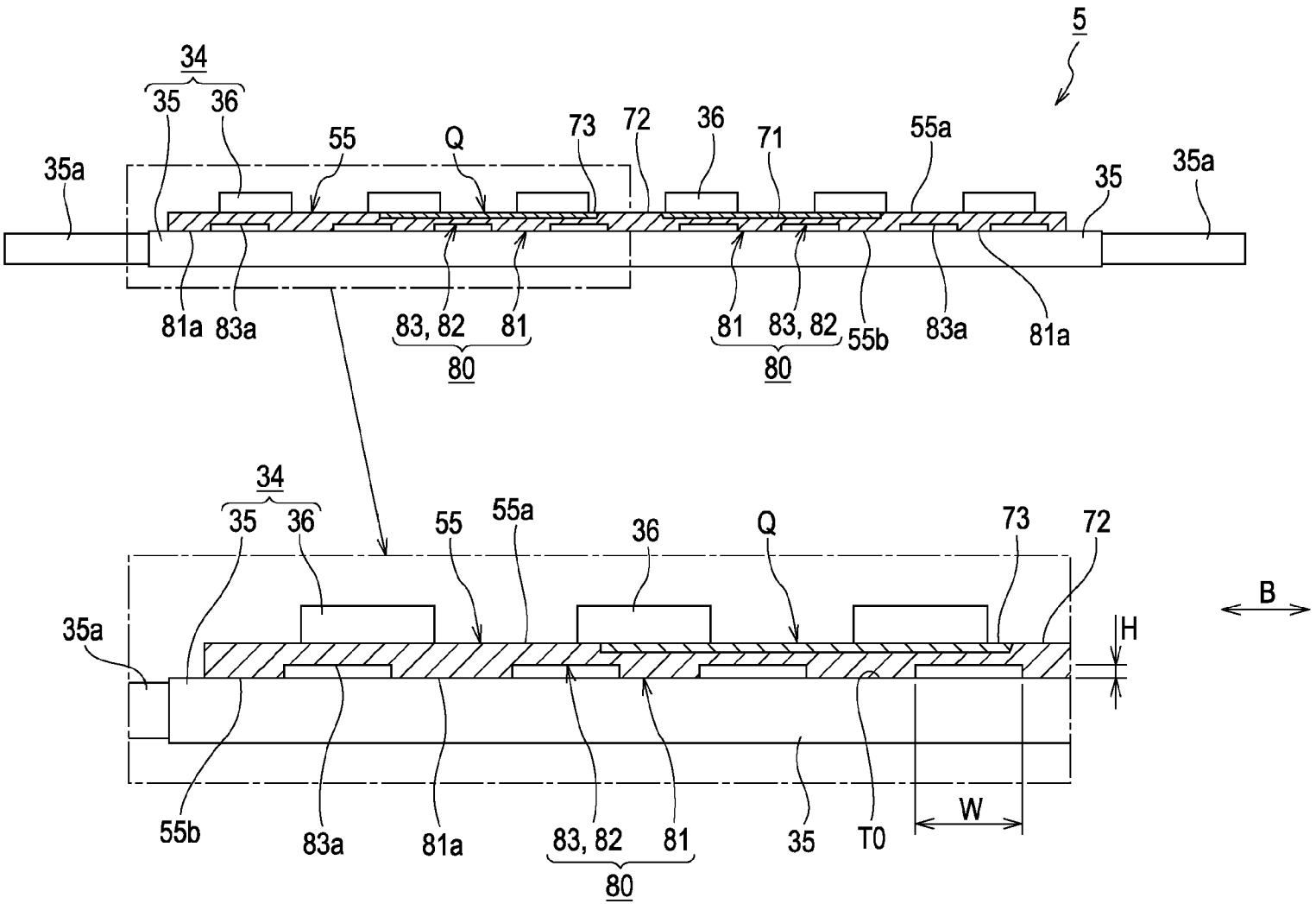
FIG. 6 includes a cross-sectional view of the transport device taken along the line VI-VI in FIG. 5 and an enlarged view of part of the cross section.
Figure 7:
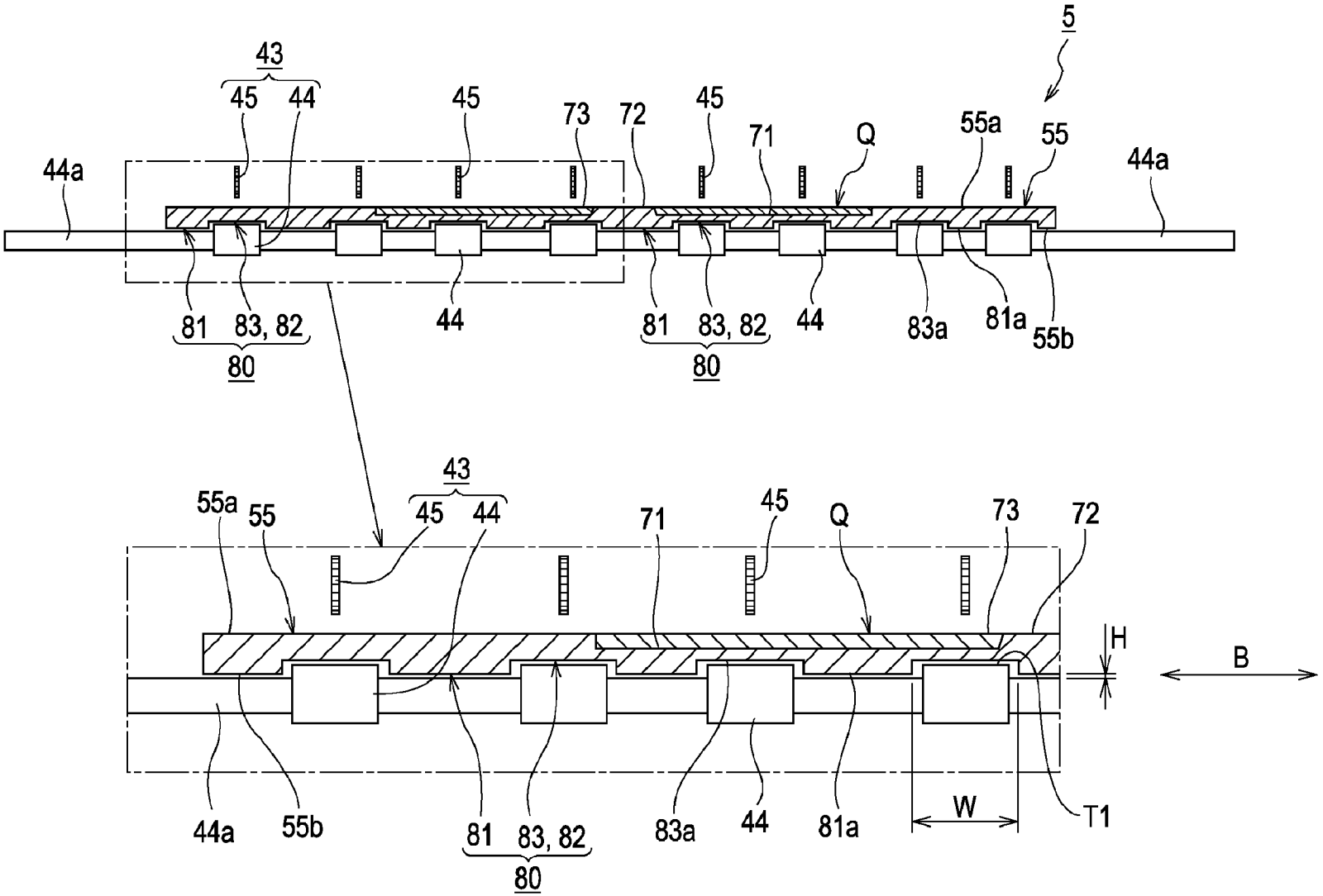
FIG. 7 includes a cross-sectional view of the transport device taken along the line VII-VII in FIG. 5 and an enlarged view of part of the cross section.
Figure 8:
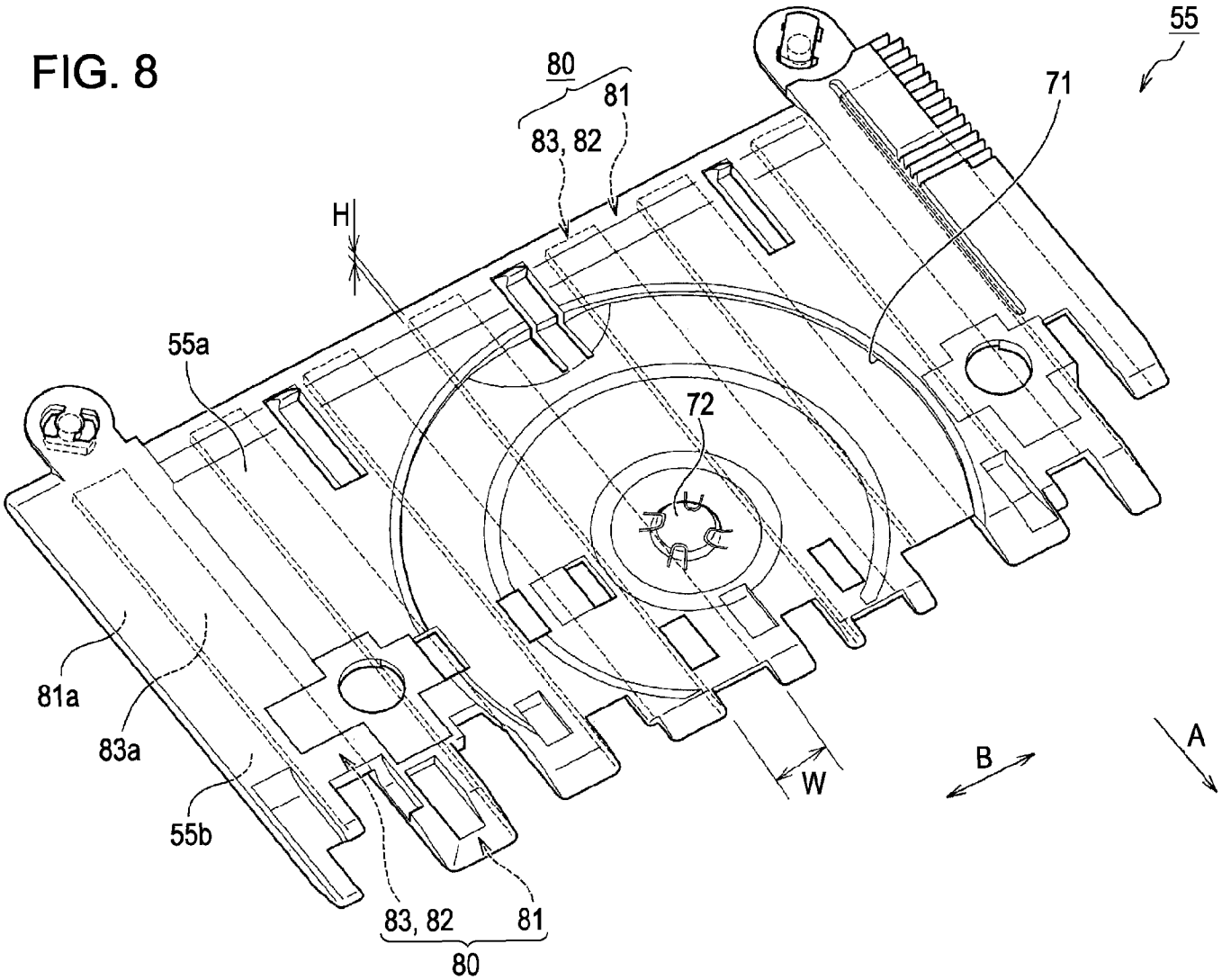
FIG. 8 is a perspective view of the holding tray when viewed from above.
Figure 9:
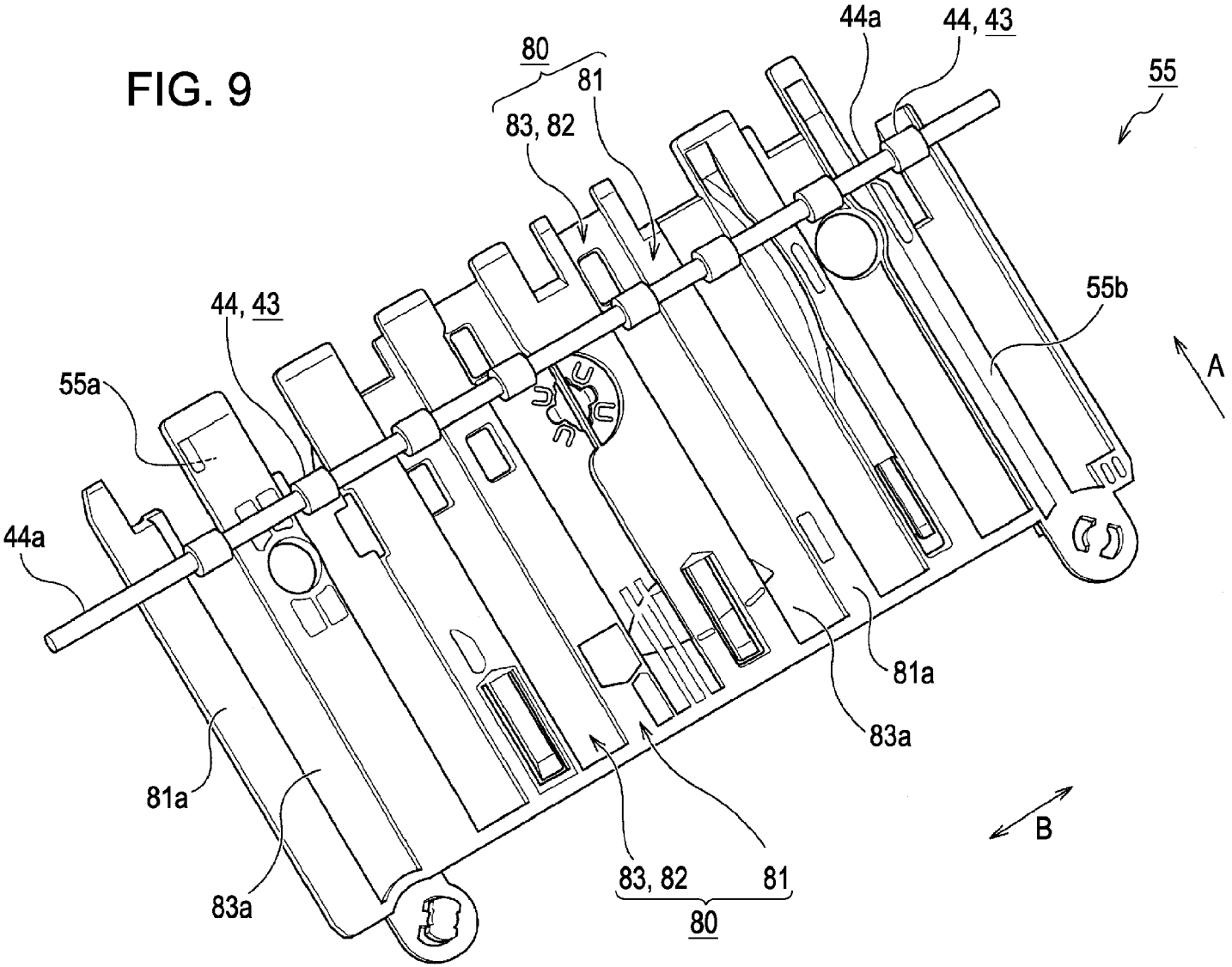
FIG. 9 is a perspective view of the holding tray when viewed from below.

FIG. 3 is a perspective view of the transport device 5 in accordance with the first embodiment when the holding tray is located in the set position. FIG. 4 is a sectional side elevation view of the transport device 5 when the holding tray 55 is located in the recording zone 51. FIG. 5 is a plan view of the transport device 5 when the holding tray 55 is located in the recording zone 51. FIG. 6 includes a cross-sectional view taken along the line VI-VI in FIG. 5 and an enlarged view of part of the above-described cross section. FIG. 7 includes a cross-sectional view taken along the line VII-VII in FIG. 5 and an enlarged view of part of the cross section. FIG. 8 is a perspective view of the holding tray 55 viewed from above, namely, illustrates one surface of the holding tray. FIG. 9 is a perspective view of the holding tray 55 viewed from below, namely, illustrates the other surface thereof.

The transport device 5 according to the first embodiment includes the above-described holding tray 55, the transport roller mechanism 34, and the ejection roller mechanism 43. In the transport device 5, the holding tray 55 has the irregular pattern 80 on the lower surface 55*b* thereof. The irregular pattern 80 includes protrusions 81 which come into contact with the outer surface of the transport driving roller 35, and recesses 82 which receive the ejection driving rollers 44, respectively. In this embodiment, the recesses 82 are equal in number to the ejection driving rollers 44. Each recess 82 includes a groove 83 extending in parallel to the transport direction A in which the second recording medium Q is transported.

The width W of each groove 83 is slightly larger than the length of the ejection driving roller 44 so as to receive the roller. The depth H of the groove 83 is set so that when the second recording medium Q is transported by the holding tray 55 while the medium is being kept in a horizontal posture, namely, while the parallelism of the recording medium relative to the ink discharge surface of the recording head 42 is being kept high, the outer surface of the ejection driving roller 44 comes into contact with the bottom surface 83*a* of the groove 83, alternatively, a space is formed between the bottom surface 83*a* of the groove 83 and the outer surface of the ejection driving roller 44. In the latter case where the space is formed between the bottom surface 83*a* of the groove 83 and the outer surface of the ejection driving roller 44, a posture keeping member that keeps the holding tray 55 in the horizontal posture is additionally needed. In this embodiment, posture keeping members 85L and 85R, serving as components of the platen 38, are arranged on the left and right sides of a path for the first recording medium P as shown in FIG. 3.

Operations of the transport device 5 in this embodiment will now be described below with respect to (1) the use of the first recording medium and (2) the use of the second recording medium.

(1) Use of First Recording Medium (Plain Paper)

To perform a recording operation on the first recording medium P, the paired nip rollers constituting the transport roller mechanism 34 pinch the first recording medium P, indicated by a virtual line in FIG. 4, to apply a transport force onto the medium. Thus, the first recording medium P enters the recording zone 51 while being pressed against the upper surface of the platen 38 and being tilted downward. After that, the first recording medium P is guided horizontally such that the medium is slid on the platen 38. The first recording medium P is transported below the recording head 42 to the nip between the rollers of the ejection roller mechanism 43. The top T1 of the outer surface of each ejection driving roller 44 is set higher than the top T0 of the outer surface of the transport driving roller 35 by an amount corresponding to the depth of each recess 82. Accordingly, the ejection roller mechanism 43 also applies a pressure to the first recording medium P such that the recording medium is pressed against the upper surface of the platen 38. Thus, the gap PG between the upper surface of the first recording medium P and the ink discharge surface as the lower surface of the recording head 42 can be stabilized in the recording zone 51.

(2) Use of Second Recording Medium (CD-R)

To perform a recording operation on the second recording medium Q shown by a solid line in FIG. 4, the second recording medium Q is allowed to reach the nip between the rollers of the transport roller mechanism 34 while being held by the holding tray 55. As shown in FIG. 6, the upper surface 55*a* of the holding tray 55 comes into contact with the outer surface of each transport driven roller 36, and the top 81*a* of each protrusion 81 in the lower surface 55*b* of the holding tray 55 comes into contact with the outer surface of the transport driving roller 35 so that a transport force is applied to the second recording medium Q. Thus, the second recording medium Q is guided to the recording zone 51.

While the holding tray 55 is passing through the recording zone 51, the holding tray 55 is kept in the horizontal posture by the posture keeping members 85L and 85R and the transport driving roller 35. When the leading edge of the holding tray 55 is located above the ejection driving rollers 44 of the ejection roller mechanism 43, the ejection driving rollers 44 enter the respective grooves 83 arranged in the lower surface 55*b* of the holding tray 55. Therefore, while the holding tray 55 is kept in the horizontal posture as it is, the second recording medium Q is transported toward a set position 53, shown in FIGS. 1 and 3, with the stabilized gap PG. During transport to the set position 53, the holding tray 55 is kept in the horizontal posture by the transport driving roller 35, the ejection driving rollers 44, and the posture keeping members 85L and 85R.

Second Embodiment

Although the recording apparatus (ink jet printer 1) according to the above-described embodiment of the invention basically has the above-described structure, the components may be partially modified or removed without departing from the spirit and scope of the invention.

Figure 10A:
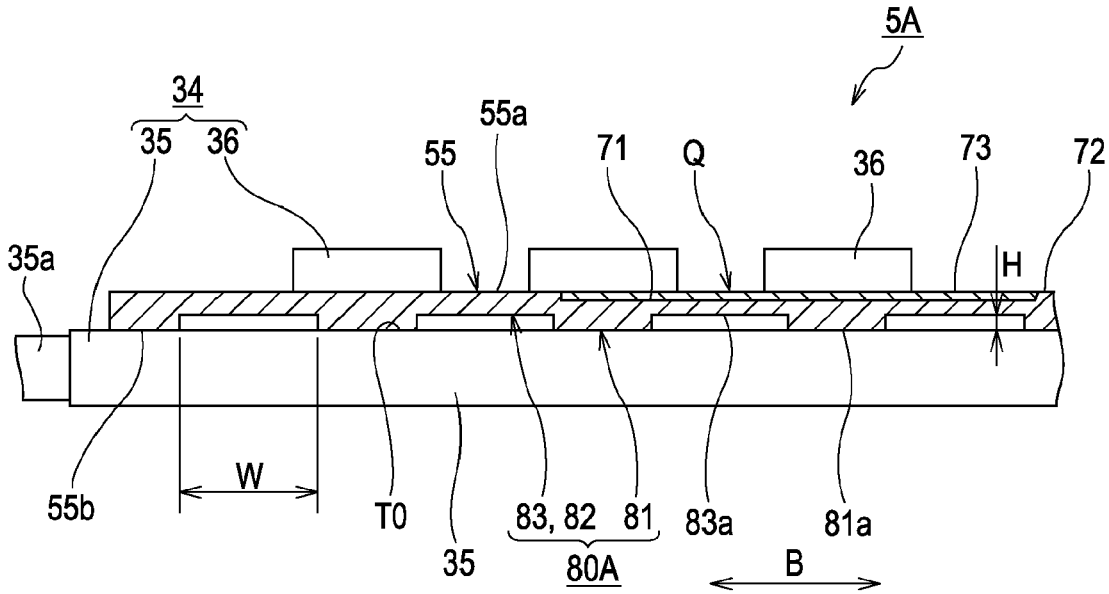
FIGS. 10A and 10B are cross-sectional views, taken along different lines, of a recording-medium transport device in another embodiment.
Figure 10B:
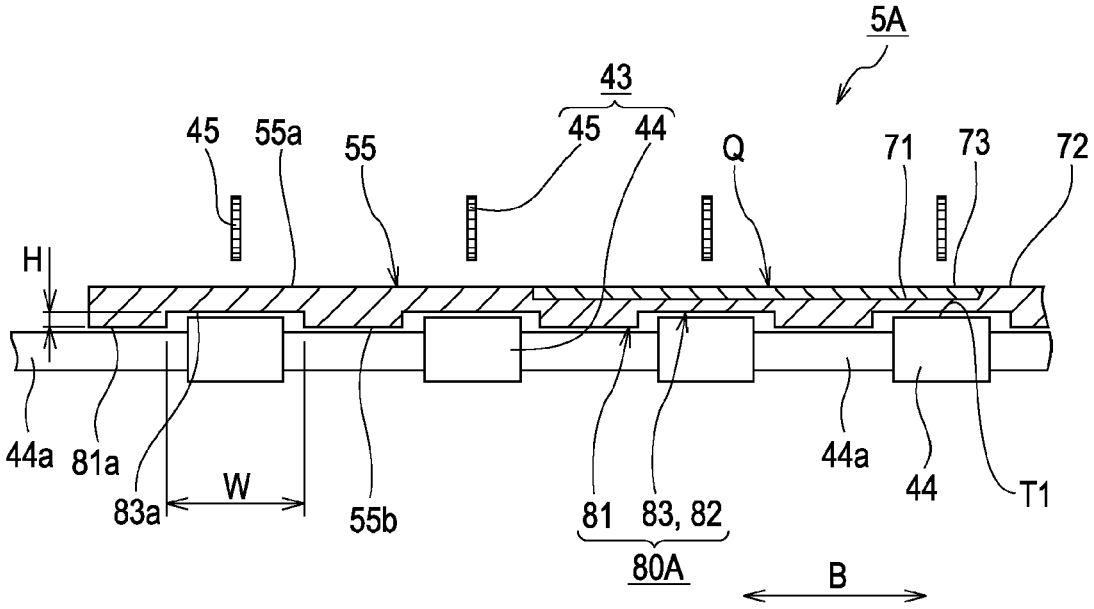

FIGS. 10A and 10B are cross-sectional views of a transport device 5A in another embodiment of the invention, the transport device 5A having an irregular pattern different from that in the first embodiment. FIG. 10A illustrates the nip between the rollers in the transport roller mechanism 34. FIG. 10B illustrates the nip between the rollers in the ejection roller mechanism 43.

Specifically, the width W of each recess 82 is not necessarily set in accordance with the length of the ejection driving roller 44. The width W thereof can also be set on the basis of the position of the corresponding transport driven roller 36 as shown in FIGS. 10A and 10B. Referring to FIGS. 10A and 10B, the irregular pattern, indicated at 80A, has protrusions 81 and recesses 82 such that each protrusion 81 is located on the lower surface 55*b* of the holding tray 55 so as to correspond to the position of the transport driven roller 36 and the width W of each recess 82 is slightly larger than the length of the ejection driving roller 44. The recording apparatus including the transport device 5A in the second embodiment shown in FIGS. 10A and 10B has the same advantages as those of the first embodiment illustrated in FIGS. 3 to 9.

Third Embodiment

Figure 11A:
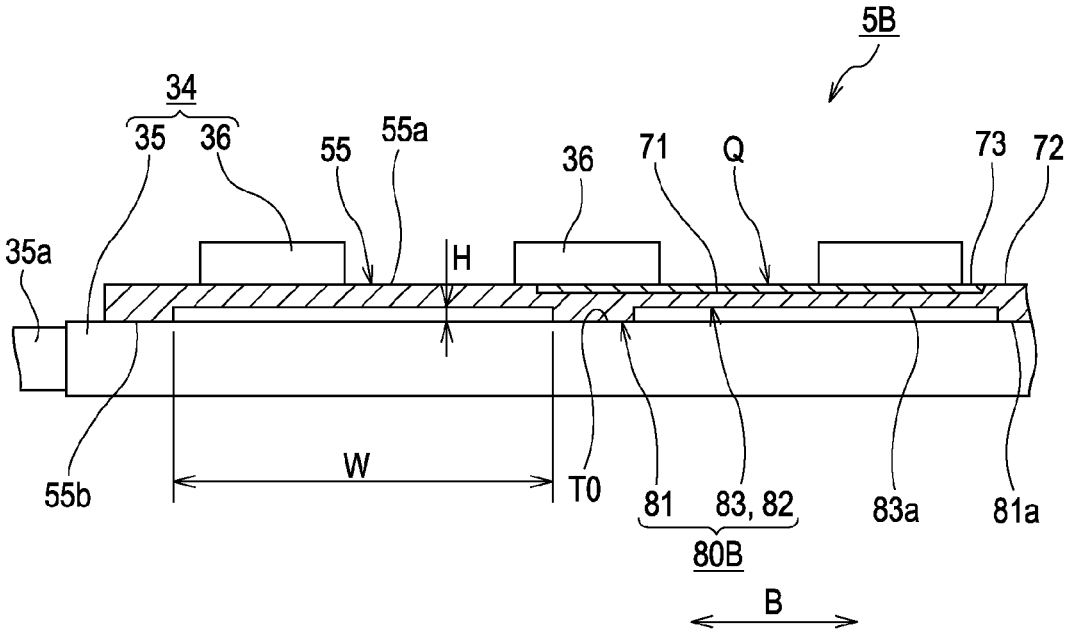
FIGS. 11A and 11B are cross-sectional views, taken along different lines, of a recording-medium transport device in further another embodiment.
Figure 11B:
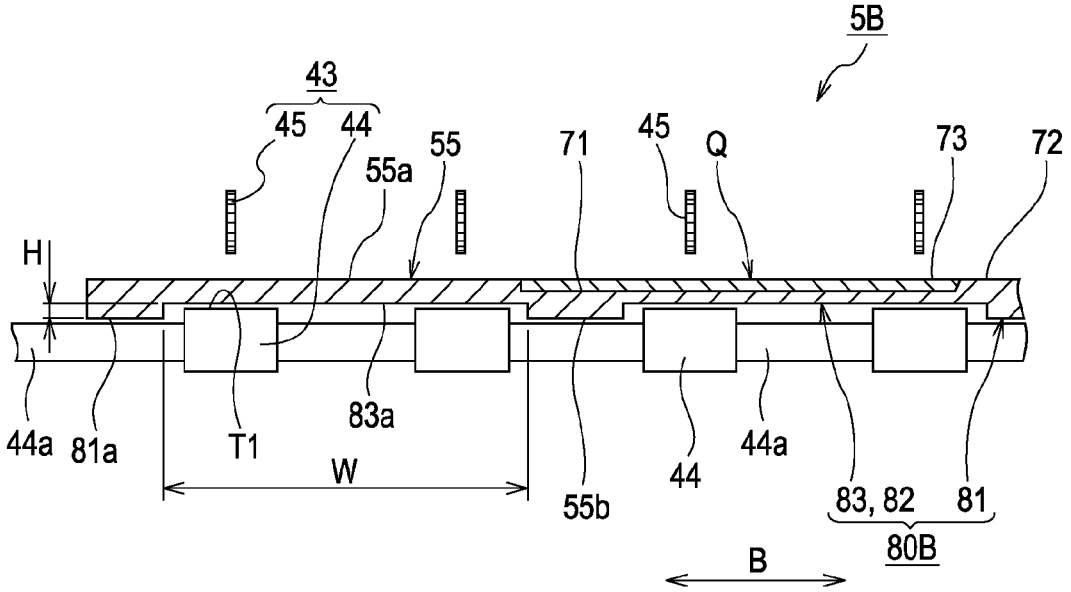

FIGS. 11A and 11B are cross-sectional views of a recording-medium transport device 5B in another embodiment of the invention, the transport device 5B having an irregular pattern different from those of the first and second embodiments. FIG. 11A illustrates the nip between the rollers in the transport roller mechanism 34. FIG. 11B illustrates the nip between the rollers in the ejection roller mechanism 43. Specifically, the number of ejection driving rollers 44 to be received in each recess 82 is not limited to one. Each recess 82 can receive a plurality of ejection driving rollers 44 as shown in FIG. 11B. The recording apparatus including the transport device 5B according to the third embodiment in FIGS. 11A and 11B has the same advantages as those of the first embodiment illustrated in FIGS. 3 to 9.

What is claimed is:

1. A recording apparatus comprising:

a holding tray;

a recording unit capable of performing a recording operation on each of a first recording medium and a second recording medium set on one surface of the holding tray, wherein the first recording medium is different from the second recording medium;

a transport driving roller that applies a transport force, directed toward the recording unit, to an opposite surface of the holding tray from the one surface on which the second recording medium is set; and an ejection driving roller located downstream of the recording unit such that the ejection driving roller is placed on the same side of the holding tray as the transport driving roller, the ejection driving roller applying an ejection force to the first recording medium, the ejection force acting in the direction in which the first recording medium is ejected, wherein the opposite surface of the holding tray has an irregular pattern including a protrusion and a recess, the protrusion coming into contact with the outer surface of the transport driving roller, the recess being located so as to face the ejection driving roller, wherein a bottom surface of the recess comes into contact with an outer surface of the ejection driving roller when the holding tray is transported.

2. The recording apparatus of claim 1, wherein the recess includes a groove extending in parallel to a transport direction in which the second recording medium is transported.

3. The recording apparatus of claim 1, wherein the recess includes a plurality of grooves extending in the direction in which the recording medium is transported, each groove having a width to receive a plurality of the ejection driving rollers.

4. The recording apparatus of claim 1, wherein the ejection driving roller is set higher than the transport driving roller by an amount corresponding to a depth of the recess.

5. A recording apparatus comprising:

a holding tray;

a recording unit capable of performing a recording operation on each of a first recording medium and a second recording medium set on one surface of the holding tray, wherein the first recording medium is different from the second recording medium;

a transport driving roller that applies a transport force, directed toward the recording unit, to an opposite surface of the holding tray from the one surface on which the second recording medium is set; and an ejection driving roller located downstream of the recording unit such that the ejection driving roller is placed on the same side of the holding tray as the transport driving roller, the ejection driving roller applying an ejection force to the first recording medium, the ejection force acting in the direction in which the first recording medium is ejected, wherein the opposite surface of the holding tray has an irregular pattern including a protrusion and a recess, the protrusion coming into contact with the outer surface of the transport driving roller, the recess being located so as to face the ejection driving roller, wherein a space is formed between a bottom surface of the recess and an outer surface of the ejection driving roller.

6. The recording apparatus of claim 5, wherein a posture of the holding tray is kept by the transport driving roller and another posture keeping member while the holding tray is transported.

7. The recording apparatus of claim 5, wherein the recess includes a groove extending in parallel to a transport direction in which the second recording medium is transported.

8. The recording apparatus of claim 5, wherein the recess includes a plurality of grooves extending in the direction in which the recording medium is transported, each groove having a width to receive a plurality of the ejection driving rollers.

9. The recording apparatus of claim 5, wherein the ejection driving roller is set higher than the transport driving roller by an amount corresponding to a depth of the recess.

10. A recording apparatus comprising:

a holding tray;

a recording unit capable of performing a recording operation on each of a first recording medium and a second recording medium set on one surface of the holding tray, wherein the first recording medium is different from the second recording medium;

a transport driving roller that applies a transport force, directed toward the recording unit, to an opposite surface of the holding tray from the one surface on which the second recording medium is set; and an ejection driving roller located downstream of the recording unit such that the ejection driving roller is placed on the same side of the holding tray as the transport driving roller, the ejection driving roller applying an ejection force to the first recording medium, the ejection force acting in the direction in which the first recording medium is ejected, wherein the opposite surface of the holding tray has an irregular pattern including a flat portion and a recess, the flat portion coming into contact with the outer surface of the transport driving roller, the recess being located so as to face the ejection driving roller, wherein the a bottom surface of the recess comes into contact with an outer surface of the ejection driving roller when transporting the holding tray.

11. The recording apparatus of claim 10, wherein the recess includes a groove extending in parallel to a transport direction in which the second recording medium is transported.

12. The recording apparatus of claim 10, wherein the recess includes a plurality of grooves extending in the direction in which the recording medium is transported, each groove having a width to receive a plurality of the ejection driving rollers.

13. The recording apparatus of claim 10, wherein the ejection driving roller is set higher than the transport driving roller by an amount corresponding to a depth of the recess.

14. A recording apparatus comprising:

a holding tray;

a recording unit capable of performing a recording operation on each of a first recording medium and a second recording medium set on one surface of the holding tray, wherein the first recording medium is different from the second recording medium;

a transport driving roller that applies a transport force, directed toward the recording unit, to an opposite surface of the holding tray from the one surface on which the second recording medium is set; and an ejection driving roller located downstream of the recording unit such that the ejection driving roller is placed on the same side of the holding tray as the transport driving roller, the ejection driving roller applying an ejection force to the first recording medium, the ejection force acting in the direction in which the first recording medium is ejected, wherein the opposite surface of the holding tray has an irregular pattern including a flat portion and a recess, the flat portion coming into contact with the outer surface of the transport driving roller, the recess being located so as to face the ejection driving roller, wherein a space is formed between a bottom surface of the recess and an outer surface of the ejection driving roller.

15. The recording apparatus of claim 14, wherein a posture of the holding tray is kept by the transport driving roller and another posture keeping member while the holding tray is transported.

16. The recording apparatus of claim 14, wherein the recess includes a groove extending in parallel to a transport direction in which the second recording medium is transported.

17. The recording apparatus of claim 14, wherein the recess includes a plurality of grooves extending in the direction in which the recording medium is transported, each groove having a width to receive a plurality of the ejection driving rollers.

18. The recording apparatus of claim 14, wherein the ejection driving roller is set higher than the transport driving roller by an amount corresponding to a depth of the recess.

* * * * *